US012110687B2

(12) United States Patent
Ayers

(10) Patent No.: US 12,110,687 B2
(45) Date of Patent: Oct. 8, 2024

(54) UNDERGROUND BASE FOR A STATIC STRUCTURE

(71) Applicant: Ryan Ayers, Sandyston, NJ (US)

(72) Inventor: Ryan Ayers, Sandyston, NJ (US)

(73) Assignee: J & J Pilings, LLC, Naples, FL (US)

( * ) Notice: Subject to any disclaimer, the term of this patent is extended or adjusted under 35 U.S.C. 154(b) by 959 days.

(21) Appl. No.: 17/131,822

(22) Filed: Dec. 23, 2020

(65) Prior Publication Data

US 2022/0195730 A1 Jun. 23, 2022

(51) Int. Cl.

| | |
|---|---|
| ***E04C 3/36*** | (2006.01) |
| ***E02D 27/42*** | (2006.01) |
| ***E04H 12/02*** | (2006.01) |
| ***E04H 12/22*** | (2006.01) |

(52) U.S. Cl.

CPC ..... *E04C 3/36* (2013.01); *E02D 27/42* (2013.01); *E04H 12/02* (2013.01); *E04H 12/22* (2013.01)

(58) Field of Classification Search

CPC ..... E04C 3/36; E02D 27/42; E04H 12/02; E04H 12/22

See application file for complete search history.

(56) References Cited

U.S. PATENT DOCUMENTS

| | | | | |
|---|---|---|---|---|
| 4,603,520 | A * | 8/1986 | Deike | E04H 17/08 52/157 |
| 6,851,247 | B1 * | 2/2005 | Turner | E04H 12/02 52/309.4 |
| 2014/0219715 | A1 * | 8/2014 | Wolf | E02D 5/06 403/381 |
| 2018/0080189 | A1 * | 3/2018 | Reinert | E02D 27/10 |
| 2018/0305884 | A1 * | 10/2018 | Jarvie | E02D 5/54 |
| 2018/0347136 | A1 * | 12/2018 | Koman | E02D 5/285 |

* cited by examiner

*Primary Examiner* — Kyle Armstrong
(74) *Attorney, Agent, or Firm* — The Webb Law Firm

(57) ABSTRACT

An underground base configured for supporting an above-ground static structure includes a plurality of plates each having a distal end, a proximal end, and a body portion between the distal end and the proximal end. Each of the plurality of plates is connected to at least another plate of the plurality of plates such that the plurality of plates defines a three-dimensional structure having an open top end and an open bottom end. The underground base further includes a plurality of brackets each connected to one of the plurality of pile plates. At least one reinforcement plate is connected to the body portion of at least one of the plurality of plates. Each of the plurality of plates is made from a first material, and the at least one reinforcement plate is made from a second material different from the first material.

19 Claims, 8 Drawing Sheets

UNDERGROUND BASE FOR A STATIC STRUCTURE

BACKGROUND OF THE DISCLOSURE

Field of the Disclosure

The present application relates generally to supports for static structures and methods for installing the supports, such as underground bases for aboveground static structures and methods for installing such underground bases.

Technical Considerations

Various commercial static structures, such as utility poles in the power transmission industry and lattice towers in the cellular telephone industry, are supported on an underground base. Typically, a conventional underground base is made of concrete. Such concrete bases are associated with a number of disadvantages, including the cost of installation, logistical challenges of getting the concrete mixed, poured, and cured in remote or inaccessible locations where static structures are often installed, and difficulty of installation in inclement weather. Some underground bases are made of steel and are driven into the soil using pressure, such as a hydraulic press.

Load requirements for an underground base are determined based on the size and weight of the static structure that the base must support, various static and dynamic loads that the static structure may experience, such as the weight of power cables attached to the static structure, wind load, or earthquake, and the composition of the underlying soil in which the underground structure is to be installed. A factor of safety is added, which further increases the weight of the underground bases. The increased weight leads to an increase in cost in making, transporting, and installing the underground base. In view of the disadvantages of existing underground bases, it would be desirable to reduce the weight of an underground base for a static structure while meeting the load requirements.

SUMMARY OF THE DISCLOSURE

Accordingly, provided is an improved underground base and a method for installing the underground base that overcomes the deficiencies of the prior art.

In some non-limiting embodiments or aspects, an underground base may be configured for supporting an aboveground static structure. The underground base may include a plurality of plates each having a distal end, a proximal end, and a body portion between the distal end and the proximal end. Each of the plurality of plates may be connected to at least another plate of the plurality of plates such that the plurality of plates defines a three-dimensional structure having an open top end and an open bottom end. The underground base further may have least one reinforcement plate connected to the body portion of at least one of the plurality of plates. Each of the plurality of plates may be made from a first material, and the at least one reinforcement plate may be made from a second material different from the first material.

In some non-limiting embodiments or aspects, the first material may be steel, and the second material may be a polymer.

In some non-limiting embodiments or aspects, each of the plates may include a first bend line between the proximal end and the distal end extending along a longitudinal length of the body portion, and a second bend line between the proximal end and the distal end extending along the longitudinal length of the body portion.

In some non-limiting embodiments or aspects, the at least one reinforcement plate may be connected to the body portion of at least one of the plurality of plates between the first bend line and the second bend line.

In some non-limiting embodiments or aspects, the first bend line may be substantially parallel to the second bend line.

In some non-limiting embodiments or aspects, the first bend line may define an angle of 22.5° to 45° between a first portion and a second portion of the body portion, and the second bend line may defines an angle of 22.5° to 45° between the first portion and a third portion of the body portion.

In some non-limiting embodiments or aspects, the distal end of each of the plurality of plates may taper inwardly from an outer surface of the body portion toward an inner surface of the body portion to define a first taper, and the distal end of the at least one reinforcement plate may taper outwardly from an inner surface toward an outer surface of the at least one reinforcement plate to define a second taper.

In some non-limiting embodiments or aspects, the first taper and the second taper may define an angle of 45° to 65°.

In some non-limiting embodiments or aspects, the underground base further may include a plurality of brackets each connected to one of the plurality of pile plates.

In some non-limiting embodiments or aspects, each of the plurality of brackets may have a bracket distal end, a bracket proximal end, a bracket body portion between the bracket proximal end and the bracket distal end, a first bend line between the bracket proximal end and the bracket distal end extending along a longitudinal length of the bracket body portion, a second bend line between the bracket proximal end and the bracket distal end extending along the longitudinal length of the bracket body portion, and a flap at the bracket proximal end.

In some non-limiting embodiments or aspects, the first bend line and the second bend line each may extend along a full longitudinal length of the bracket.

In some non-limiting embodiments or aspects, the flap may define a third bend line that is substantially perpendicular to the first bend line and the second bend line.

In some non-limiting embodiments or aspects, the first bend line may define an angle of 22.5° to 45° between a first portion and a second portion of the bracket body portion, and the second bend line may define an angle of 22.5° to 45° between the first portion and a third portion of the bracket body portion.

In some non-limiting embodiments or aspects, each of the plurality of brackets further may include one or more gussets extending from the body portion of the bracket to the flap.

In some non-limiting embodiments or aspects, the underground base further may include a base plate connected to the plurality of brackets and covering the open top end of the three-dimensional structure.

In some non-limiting embodiments or aspects, the base plate may define a plurality of holes for receiving a plurality of mechanical fasteners configured for connecting the static structure to the base plate.

In some non-limiting embodiments or aspects, the underground base further may include a support plate connected body portion of at least two of the plurality of plates and disposed between the distal end and the proximal end of the plurality of plates.

In some non-limiting embodiments or aspects, the underground base further may include at least one stabilizing bracket connected at a joint between adjacent plates of the plurality of plates and extending radially outward relative to the body portion of the plates.

In some non-limiting embodiments or aspects, the at least one stabilizing bracket may have a first portion connected to the joint between adjacent plates of the plurality of plates and a second portion extending substantially perpendicular to the first portion.

In some non-limiting embodiments or aspects, an underground base may be configured for supporting an above-ground static structure. The underground base may include a plurality of plates each having a distal end, a proximal end, and a body portion between the distal end and the proximal end. Each of the plurality of plates may be connected to at least another plate of the plurality of plates such that the plurality of plates defines a three-dimensional structure having an open top end and an open bottom end. The underground base further may include a plurality of brackets each connected to one of the plurality of pile plates, and at least one stabilizing bracket connected at a joint between adjacent plates of the plurality of plates and extending radially outward relative to the body portion of the plates. The underground base further may include at least one reinforcement plate connected to the body portion of at least one of the plurality of plates. Each of the plurality of plates may be made from a first material, and the at least one reinforcement plate may be made from a second material different from the first material.

Further non-limiting embodiments or aspects are set forth in the following numbered clauses:

Clause 1. An underground base configured for supporting an above-ground static structure, the underground base comprising: a plurality of plates each having a distal end, a proximal end, and a body portion between the distal end and the proximal end, each of the plurality of plates connected to at least another plate of the plurality of plates such that the plurality of plates defines a three-dimensional structure having an open top end and an open bottom end; and at least one reinforcement plate connected to the body portion of at least one of the plurality of plates, wherein each of the plurality of plates is made from a first material, and wherein the at least one reinforcement plate is made from a second material different from the first material.

Clause 2. The base of clause 1, wherein the first material is steel, and wherein the second material is a polymer.

Clause 3. The underground base according to clause 1 or 2, wherein each of the plates comprises: a first bend line between the proximal end and the distal end extending along a longitudinal length of the body portion; and a second bend line between the proximal end and the distal end extending along the longitudinal length of the body portion.

Clause 4. The underground base according to any of clauses 1-3, wherein the at least on reinforcement plate is connected to the body portion of at least one of the plurality of plates between the first bend line and the second bend line.

Clause 5. The underground base according to any of clauses 1-4, wherein the first bend line is substantially parallel to the second bend line.

Clause 6. The underground base according to any of clauses 1-5, wherein the first bend line defines an angle of 22.5° to 45° between a first portion and a second portion of the body portion, and wherein the second bend line defines an angle of 22.5° to 45° between the first portion and a third portion of the body portion.

Clause 7. The underground base according to any of clauses 1-6, wherein the distal end of each of the plurality of plates tapers inwardly from an outer surface of the body portion toward an inner surface of the body portion to define a first taper, and wherein the distal end of the at least one reinforcement plate tapers outwardly from an inner surface toward an outer surface of the at least one reinforcement plate to define a second taper.

Clause 8. The underground base according to any of clauses 1-7, wherein the first taper and the second taper define an angle of 45° to 65°.

Clause 9. The underground base of any of clauses 1-8, further comprising a plurality of brackets each connected to one of the plurality of pile plates.

Clause 10. The underground base according to any of clauses 1-9, wherein each of the plurality of brackets comprises: a bracket distal end; a bracket proximal end; a bracket body portion between the bracket proximal end and the bracket distal end; a first bend line between the bracket proximal end and the bracket distal end extending along a longitudinal length of the bracket body portion; a second bend line between the bracket proximal end and the bracket distal end extending along the longitudinal length of the bracket body portion; and a flap at the bracket proximal end.

Clause 11. The underground base according to any of clauses 1-10, wherein the first bend line and the second bend line each extend along a full longitudinal length of the bracket.

Clause 12. The underground base according to any of clauses 1-11, wherein the flap defines a third bend line that is substantially perpendicular to the first bend line and the second bend line.

Clause 13. The underground base according to any of clauses 1-12, wherein the first bend line defines an angle of 22.5° to 45° between a first portion and a second portion of the bracket body portion, and wherein the second bend line defines an angle of 22.5° to 45° between the first portion and a third portion of the bracket body portion.

Clause 14. The underground base according to any of clauses 1-13, wherein each of the plurality of brackets further comprises one or more gussets extending from the body portion of the bracket to the flap.

Clause 15. The underground base of any of clauses 1-14, further comprising a base plate connected to the plurality of brackets and covering the open top end of the three-dimensional structure.

Clause 16. The underground base according to any of clauses 1-15, wherein the base plate defines a plurality of holes for receiving a plurality of mechanical fasteners configured for connecting the static structure to the base plate.

Clause 17. The underground base according to any of clauses 1-16, further comprising a support plate connected body portion of at least two of the plurality of plates and disposed between the distal end and the proximal end of the plurality of plates.

Clause 18. The underground base according to any of clauses 1-17, further comprising at least one stabilizing bracket connected at a joint between adjacent plates of the plurality of plates and extending radially outward relative to the body portion of the plates.

Clause 19. The underground base according to any of clauses 1-18, wherein the at least one stabilizing bracket has a first portion connected to the joint between adjacent plates of the plurality of plates and a second portion extending substantially perpendicular to the first portion.

Clause 20. An underground base configured for supporting an above-ground static structure, the underground base comprising: a plurality of plates each having a distal end, a proximal end, and a body portion between the distal end and the proximal end, each of the plurality of plates connected to at least another plate of the plurality of plates such that the plurality of plates defines a three-dimensional structure having an open top end and an open bottom end; a plurality of brackets each connected to one of the plurality of pile plates; at least one stabilizing bracket connected at a joint between adjacent plates of the plurality of plates and extending radially outward relative to the body portion of the plates; and at least one reinforcement plate connected to the body portion of at least one of the plurality of plates, wherein each of the plurality of plates is made from a first material, and wherein the at least one reinforcement plate is made from a second material different from the first material.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

BRIEF DESCRIPTION OF THE DRAWINGS

Additional advantages and details of the disclosure are explained in greater detail below with reference to the exemplary embodiments or aspects that are illustrated in the accompanying schematic figures, in which.

DETAILED DESCRIPTION OF THE DISCLOSURE

Figure 1:
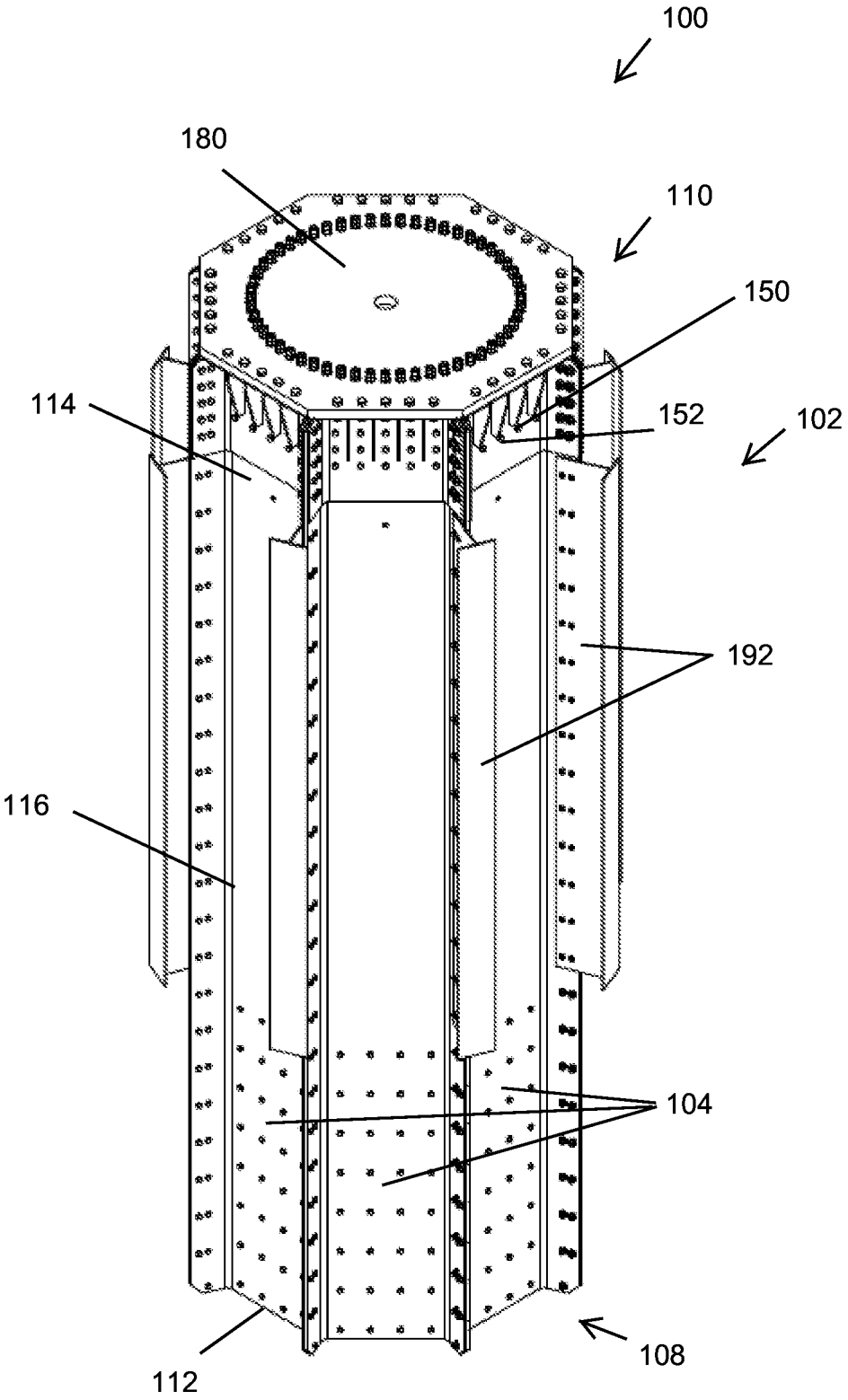
FIG. 1 is a perspective view of an underground base for a static structure according to one embodiment or aspect of the present disclosure.

As used herein, the singular form of "a", "an", and "the" include plural referents unless the context clearly dictates otherwise.

Spatial or directional terms, such as "left", "right", "inner", "outer", "above", "below", and the like, relate to the embodiments or aspects as shown in the drawing figures and are not to be considered as limiting as the embodiments or aspects can assume various alternative orientations.

All numbers used in the specification and claims are to be understood as being modified in all instances by the term "about". By "about" is meant within plus or minus twenty-five percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of various examples or aspects may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the various examples and aspects described herein.

The disclosure comprises, consists of, or consists essentially of, the following examples or aspects, in any combination. Various examples or aspects of the disclosure are illustrated in separate drawing figures. However, it is to be understood that this is simply for ease of illustration and discussion. In the practice of the disclosure, one or more examples or aspects shown in one drawing figure can be combined with one or more examples or aspects shown in one or more of the other drawing figures.

Figure 11:
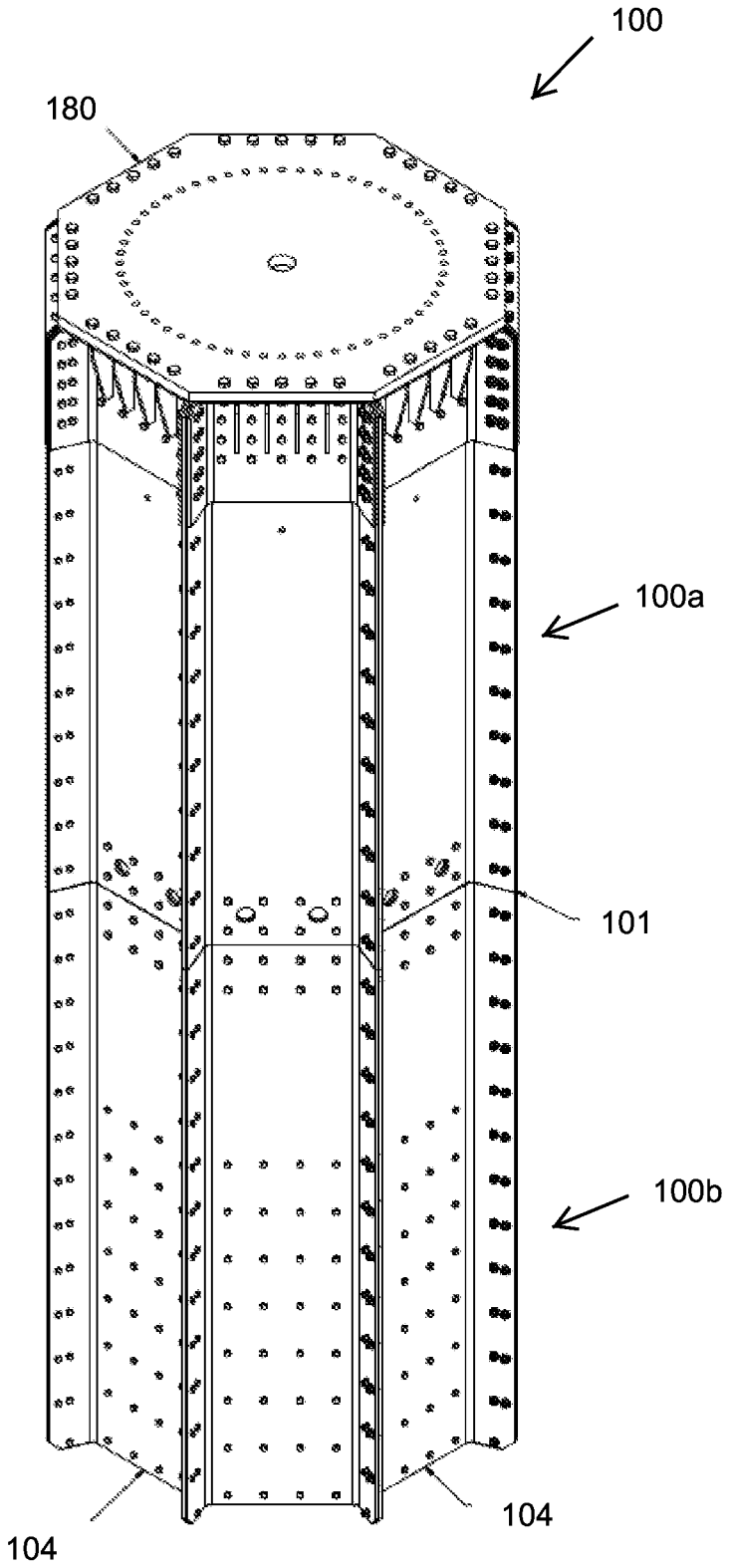
FIG. 11 is a perspective view of an underground base for a static structure according to another embodiment or aspect of the present disclosure.
Figure 12:
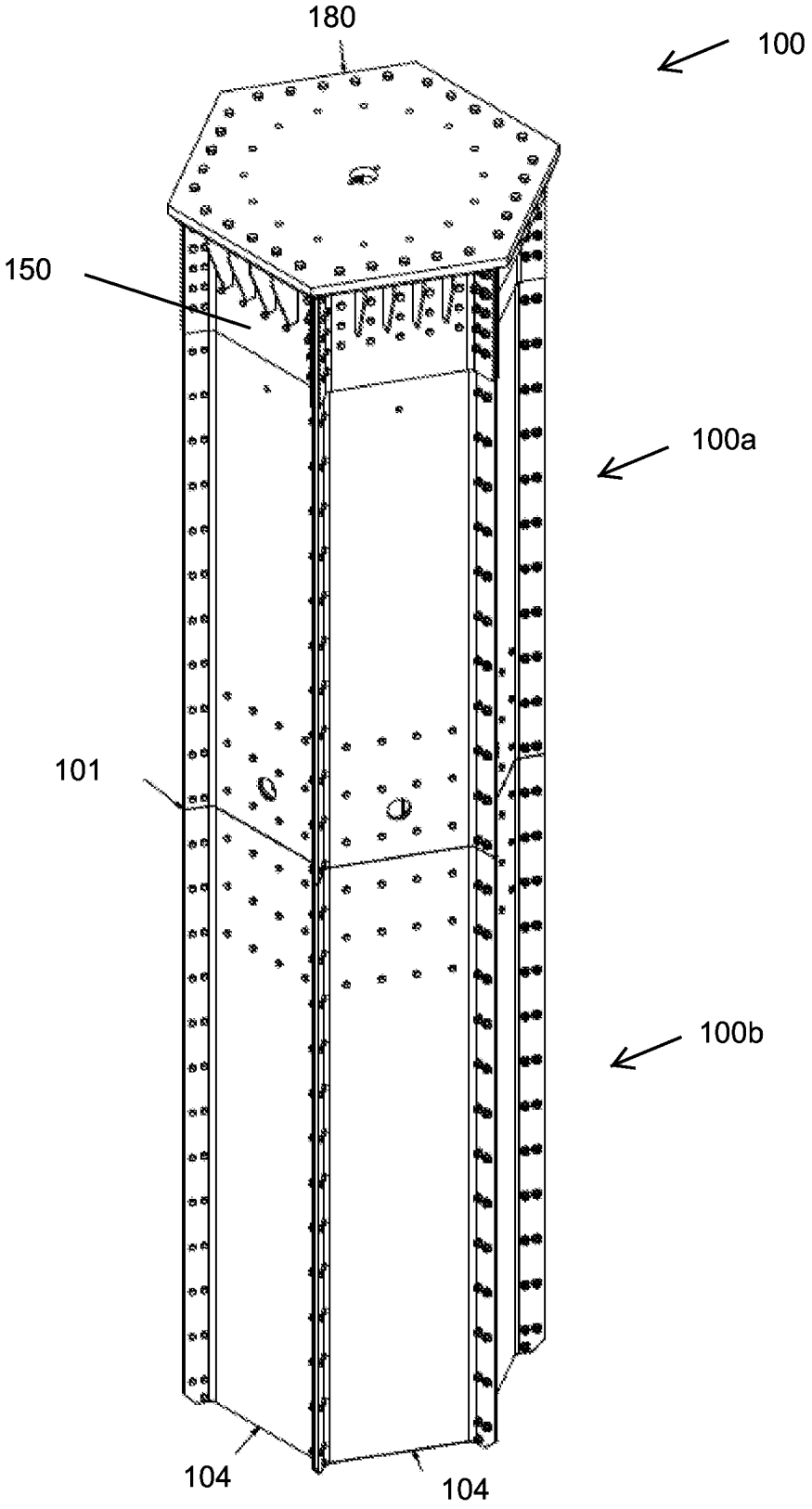
FIG. 12 a perspective view of an underground base for a static structure according to another embodiment or aspect of the present disclosure.

With reference to FIG. 1, an underground base 100 (hereinafter referred to as "base 100") configured for supporting above-ground static structures is shown in accordance with one embodiment or aspect of the present disclosure. The underground base 100 is configured for underground installation by being hydraulically pushed or otherwise driven into the soil. For example, the base 100 may be configured for being pushed or otherwise driven into the soils by a hydraulic ram. In some embodiments or aspects, at least a portion of a longitudinal length of the base 100 is configured for being installed underground. In some embodiments or aspects, the base 100 may be configured for supporting an above-ground static structure, such as a utility pole used in the power transmission industry, or a lattice tower in the cellular industry. In this manner, at least a portion of the base 100 may be exposed from the ground to allow for connection of the above-ground static structure to the base 100. The base 100 may be construed as a single-piece structure (FIG. 1), or as a plurality of separate structures 100*a*, 100*b* that are joined together at a joint 101 to form the base 100 (FIGS. 11-12). In this manner, the separate structures 100*a*, 100*b* can be made to have a shorter length for easier transport, and then assembled on site for final installation as a full-length base 100.

The base 100 provides a lightweight structure compared to conventional reinforced concrete bases while meeting the same load and soil support requirements as the concrete bases. The reduced weight of the base 100 compared to conventional concrete bases allows the base to be easily and efficiently transported to the installation site. Additionally, the base 100 can be installed into the soil in a matter of hours and does not require lengthy curing times associated with pouring conventional concrete bases. Unlike the concrete bases, the installation of the base 100 is not dependent on the weather conditions.

With reference to FIG. 1, the base 100 has a body 102 made from a plurality of plates 104 that are connected together to define a three-dimensional structure that defines an outer shape of the base 100. In some embodiments or aspects, the plurality of plates 104 are connected to each other via one or more fasteners 105. In other embodiments or aspects, the plurality of plates 104 are connected to teach other via welding, adhesive, fasteners, and any combination thereof.

Figure 2:
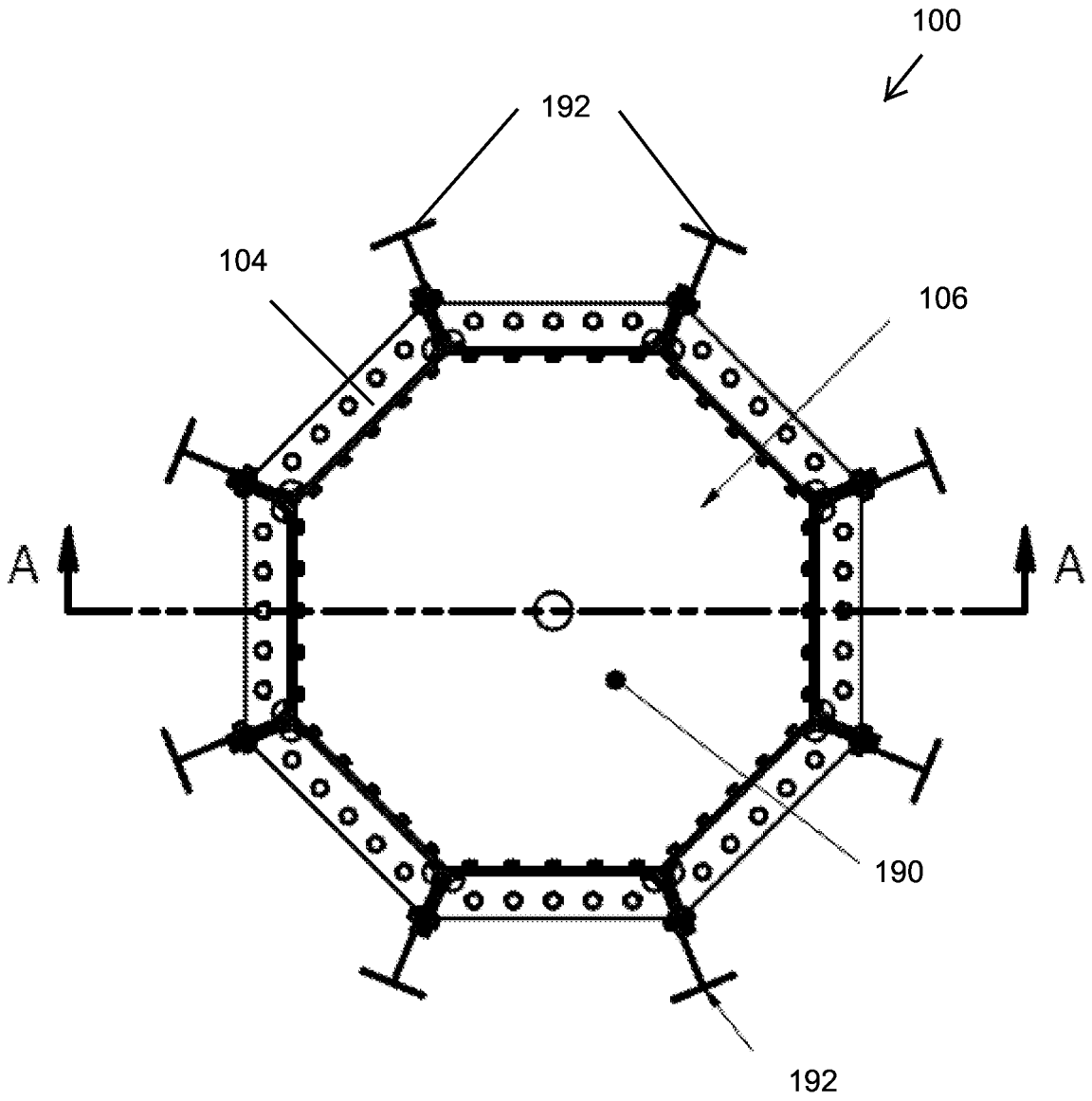
FIG. 2 is a top view of the underground base with a top plate shown in FIG. 1 removed.

With continued reference to FIG. 1, the plates 104 may be identical to each other. In some embodiments or aspects, at least one of the plates 104 may be different from the remaining plates 104. In some embodiments or aspects, the plurality of plates 104 may be arranged to define various cross-sectional shapes of the base 100. For example, the plurality of plates 104 may include eight plates that define an octagonal cross-sectional shape of the base 100 (see FIG. 2). In other embodiments or aspects, the plurality of plates 104 may include six plates that define a hexagonal cross-sectional shape of the base 100 (see FIG. 12). In further embodiments or aspects, the plurality of plates 104 may be 3 to n plates, where n is an integer number greater than 3. The three-dimensional structure defined by the plurality of plates 104 has an open top end 106 (shown in FIG. 2) and an open bottom end (not shown). The size and shape of the base 100 is desirably selected to meet the load requirements for the above-ground static structure that will be supported by the base 100. The wider that a diameter of the base 100 is, the better suited the base 100 is for withstanding an overturning moment force to prevent the static structure from tipping over.

With continued reference to FIG. 1, the base 100 has a distal portion 108 that is configured to be furthest from the soil surface when the base 100 is installed in the soil and an opposite proximal portion 110 that is configured to be closest to the soil surface (i.e. slightly above, at the same level, or slightly below).

With continued reference to FIG. 1, each of the plurality of plates 104 has a first or distal end 112, a second or proximal end 114, and a body portion 116 extending between the distal end 112 and the proximal end 114. The plates 104 may be connected to each other along at least a portion of a longitudinal length of the body portion 116. For example, the plates 104 may be connected to each other along an entire longitudinal length of the body portion 116. Each of the plurality of plates 104 may be made from the same material or a different material. The plates 104 may be made from a planar or sheet stock. In some embodiments or aspects, each of the plurality of plates 104 is made from a first material, such as steel. The steel may be carbon steel. Each plate 104 may have a thickness of 0.5" to 1.0".

Figure 3:
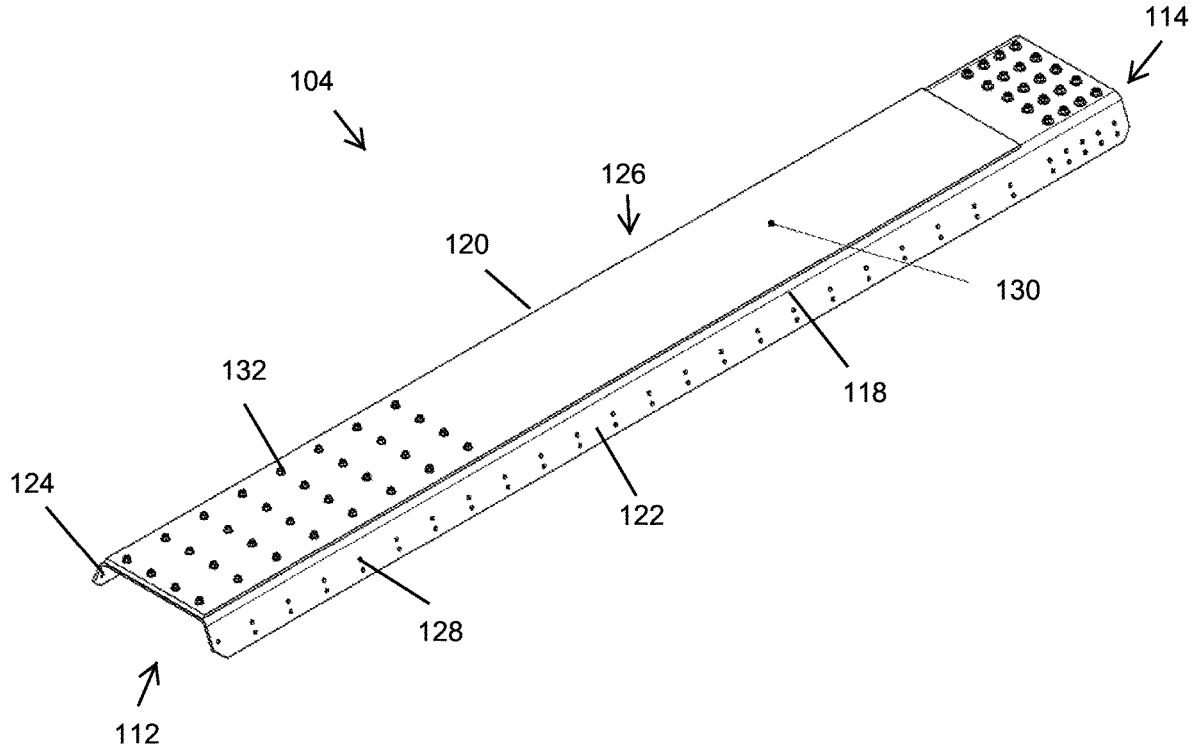
FIG. 3 is a perspective view of one section of an underground base shown in FIG. 1.
Figure 4:
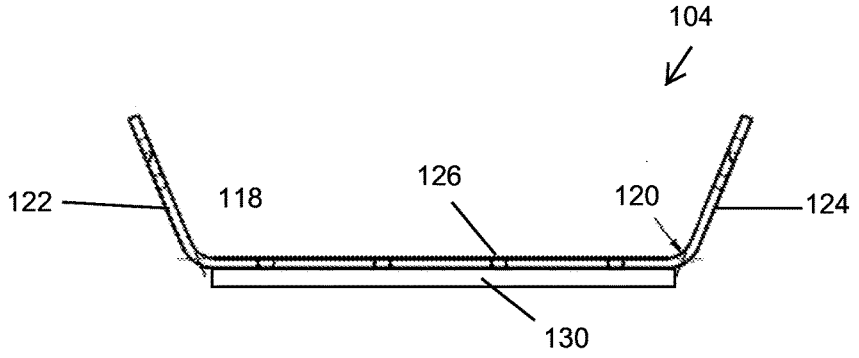
FIG. 4 is a top view of the section shown in FIG. 3.
Figure 5:
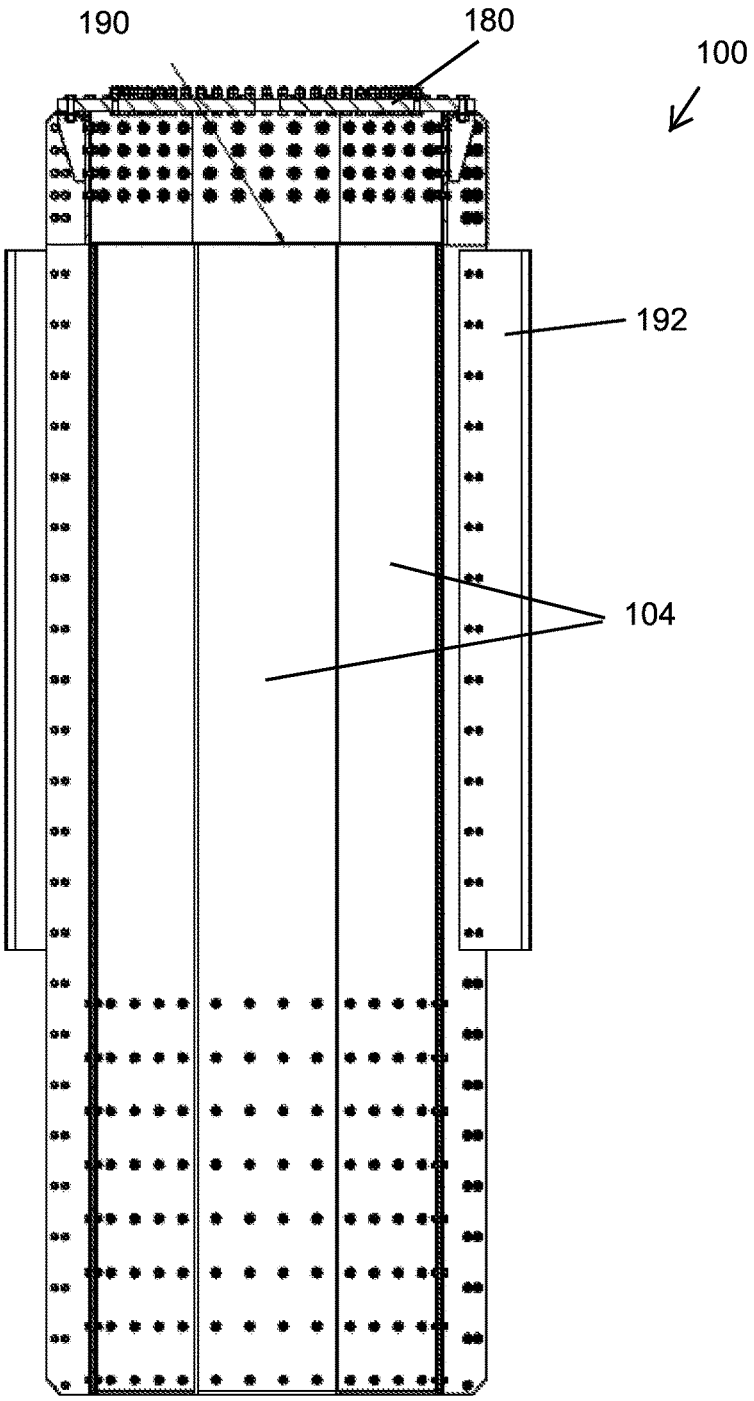
FIG. 5 is cross-sectional view of section A-A of the underground base shown in FIG. 2.

With reference to FIGS. 3-4, a single plate 104 is shown without the remaining plates 104 of the base 100. Each plate 104 has a first bend line 118 between the proximal end 114 and the distal end 112 extending along a longitudinal length of the body portion 116. Each plate 104 further has a second bend line 120 between the proximal end 114 and the distal end 112 extending along the longitudinal length of the body portion 116. The first bend line 118 and the second bend line 120 are substantially parallel to each other and extend along the entire length of the body portion 116. In this manner, the first bend line 118 and the second bend line 120 divide the body portion 116 into a first flap portion 122, a second flap portion 124, and a central portion 126. In some non-limiting embodiments or aspects, the first bend line 118 may define an angle of 22.5° to 45° between the first flap portion 122 and the central portion 126, and the second bend line 120 may defines an angle of 22.5° to 45° between the second flap portion 124 and the central portion 126. The angles defined at the first and second bend lines 116, 118 are determined based on a desired shape of the three-dimensional structure. Each of the first and second flap portions 122, 124 may have a plurality of through holes 128 configured for receiving fasteners for connecting the plate 104 to adjoining plates 104.

With continued reference to FIGS. 3-4, at least one of the plates 104 has least one reinforcement plate 130 connected thereto. In some embodiments or aspects, the reinforcement plate 130 may be connected to the central portion 126 of the plate 104 such that it is positioned between the first and second flap portions 122, 124. The reinforcement plate 130 may be connected to what is an inner surface of the plate 104 such that the reinforcement plates 130 are positioned within an interior of the three-dimensional structure defined by the plates 104. In some embodiments or aspects, the reinforcement plate 130 may be connected to the plate 104 by a plurality of fasteners 132. In other embodiments or aspects, the reinforcement plate 130 may be adhesively connected to the plate 104 or be welded to the plate 104.

The reinforcement plate 130 may extend along at least a portion of the longitudinal length of the plate 104. The reinforcement plate 130 may have a thickness of 0.25" to 1.0". The reinforcement plate 130 is desirably made from a material different from the material of the plate 104. In some embodiments or aspects, the reinforcement plate 130 may be made from a polymer material. In other embodiments or aspects, the reinforcement plate 130 may be made from the same material as the plate 104. For example, the reinforcement plate 130 may be made from carbon steel. The reinforcement plate 130 increases the strength of the plate 104 without adding a substantial weight to the overall assembly. For example, the reinforcement plate 104 prevents buckling of the plates 104 and reinforces the base 100.

Figure 6:
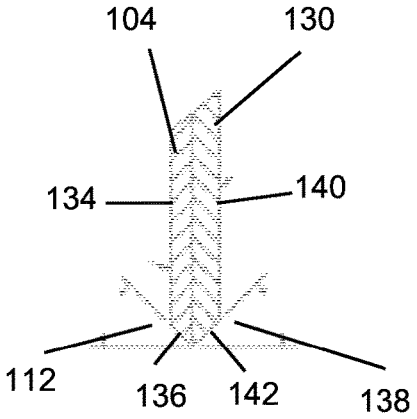
FIG. 6 is a detailed cross-sectional view of section B-B shown in FIG. 5.

In some non-limiting embodiments or aspects, and with reference to FIG. 6, the distal end 112 of each of the plurality of plates 104 may taper inwardly from an outer surface 134 of the plate 104 toward an inner surface to define a first taper 136. In embodiments where a distal end 138 of the reinforcement plate 130 extends to the terminal surface of the distal end 112 of the plate 104, the distal end 138 of the reinforcement plate 130 may taper outwardly from an inner surface 140 toward an outer surface of the at least one reinforcement plate to define a second taper 142. In some non-limiting embodiments or aspects, the first taper 136 and the second taper 142 may define an angle of 45° to 65°. The beveled edge provided by the first taper 136 and the second taper 142 makes it easier for the base 100 to penetrate the soil during installation and helps reduce the installation costs, since additional equipment, such as a backhoe, dump truck, and related operators and laborers, is not required.

Figure 7:
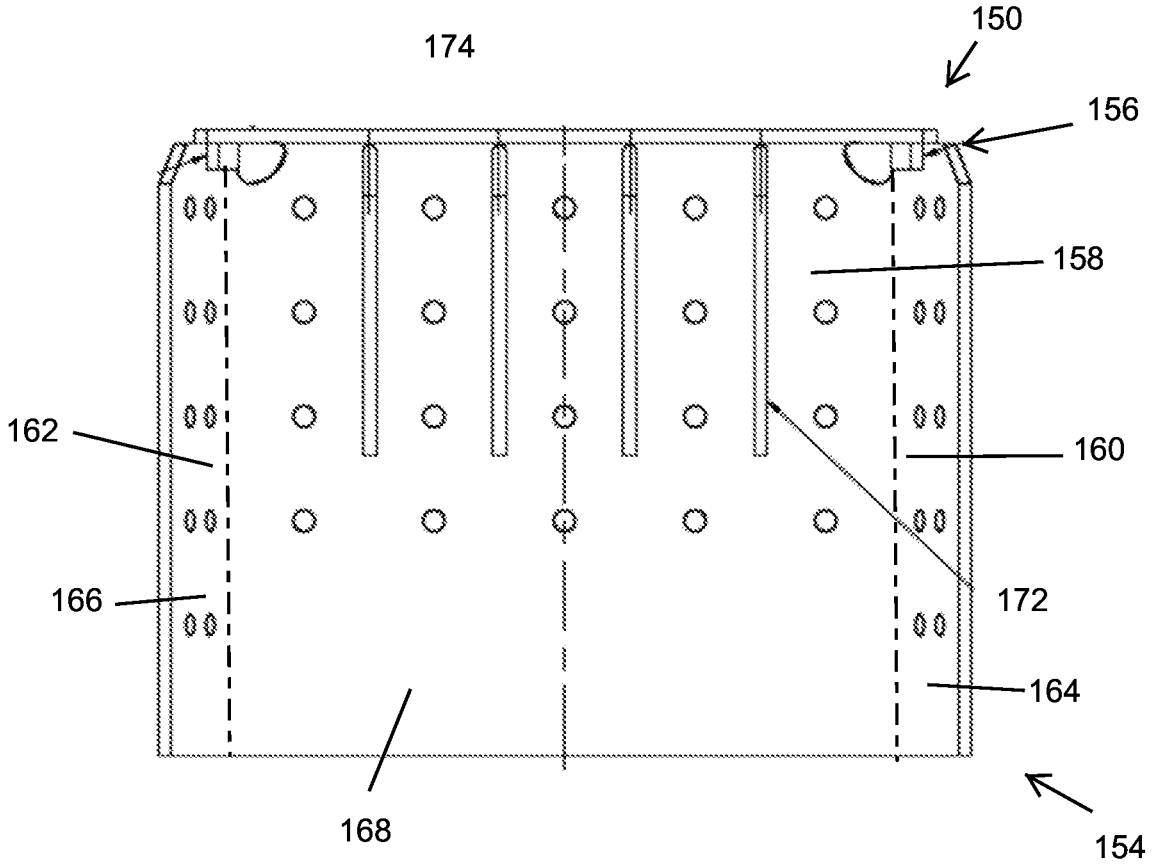
FIG. 7 is a side view of a bracket plate for an underground base.
Figure 8:
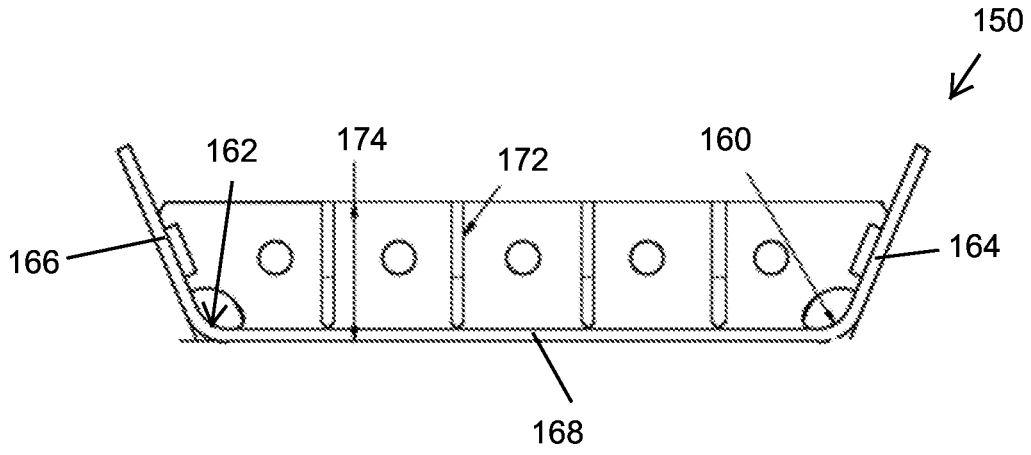
FIG. 8 is a bottom view of the bracket plate shown in FIG. 7.

With reference to FIGS. 1 and 7-8, the base 100 (shown in FIG. 1) further may include a plurality of brackets 150 each connected to one of the plurality of plates 104. Each bracket 150 may be configured for connecting to the proximal end 114 of the plate 104. In some embodiments or aspects, the bracket 150 may be connectable to the plate 104 via one or more bracket fasteners 152 (shown in FIG. 1).

With reference to FIGS. 7-8, each bracket 150 has a bracket distal end 154, a bracket proximal end 156, a bracket body portion 158 between the bracket proximal end 156 and the bracket distal end 154. The bracket 150 further has a first bend line 160 between the bracket proximal end 156 and the bracket distal end 154 extending along a longitudinal length of the bracket body portion 158, and a second bend line 162 between the bracket proximal end 156 and the bracket distal end 154 extending along a longitudinal length of the bracket body portion 158. The first bend line 160 and the second bend line 162 may be substantially parallel to each other.

The first bend line 160 and the second bend line 162 may extend along the entire length of the bracket body portion 158. In this manner, the first bend line 160 and the second bend line 162 divide the bracket body portion 158 into a first flap portion 164, a second flap portion 166, and a central portion 168. In some non-limiting embodiments or aspects, the first bend line 160 may define an angle of 22.5° to 45° between the first flap portion 164 and the central portion 168, and the second bend line 162 may define an angle of 22.5° to 45° between the second flap portion 166 and the central portion 168. The angles defined at the first and second bend lines 160, 162 are determined based on a desired shape of the three-dimensional structure. The first and second flap portions 164, 166 and the central portion 168 may have a plurality of through holes 170 configured for receiving the bracket fasteners for connecting the bracket 160 to the plate 104.

With continued reference to FIGS. 7-8, the bracket 150 further has a top flap 174 at the bracket proximal end 156. The top flap 174 defines a third bend line 176. The third bend line 176 may be substantially perpendicular to the first and second bend lines 160, 162. In some embodiments or aspects, a plurality of gussets 172 may be connected to the bracket body portion 158 and the top flap 174. The top flap 174 may be configured for supporting a top plate, as further discussed herein.

Figure 9:
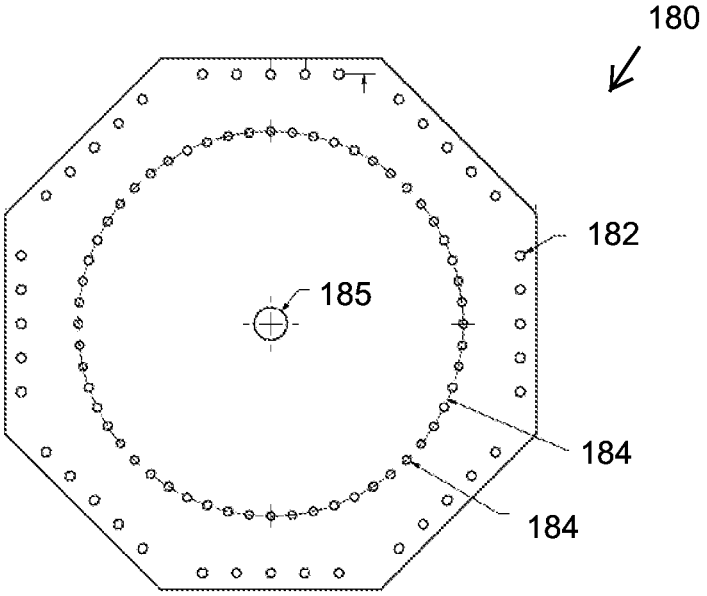
FIG. 9 is top view of a top plate for an underground base.

With reference to FIG. 9, a base plate 180 is provided for connecting to the proximal portion 110 of the body 108 of the base 100. The base plate 180 is configured to connect to the plurality of brackets 150 and encloses the open top end of the base 100 (see FIG. 1). The base plate 180 defines a plurality of first holes 182 for receiving a plurality of mechanical fasteners configured for connecting the static structure to the base plate 180. The base plate 180 further has a plurality of second holes 184 for receiving a plurality of mechanical fasteners configured for connecting the brackets 150 to the base plate 180. The base plate 180 may be made from the same material as the plurality of plates 104, such as steel. The base plate 180 may have a central opening 185.

Figure 10:
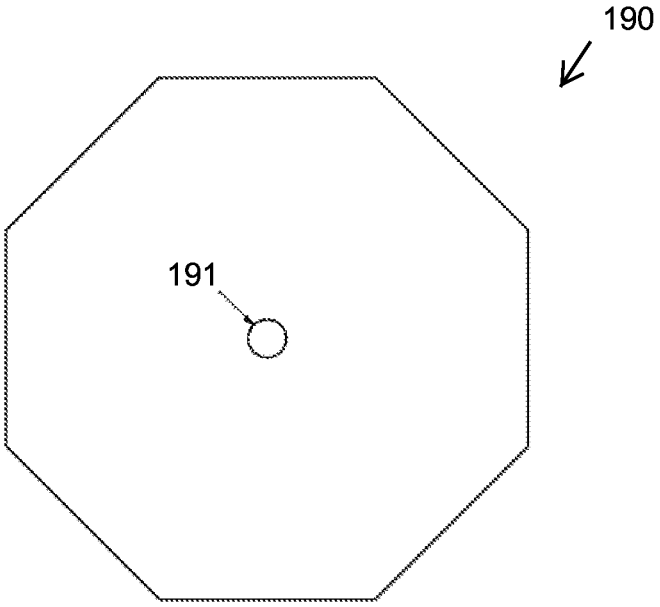
FIG. 10 is a top view of a stiffener plate for an underground base.

With reference to FIG. 10, a support plate 190 is provided for supporting an interior of the base 100 between the proximal portion 110 and the distal portion 108 (shown in FIG. 1). The support plate 190 is configured to connect to the inner surface of the plurality of plates 104 to support the plates 104 from buckling inwardly due to soil pressure (see FIG. 2). The support plate 190 may be connected to the plurality of plates 104 via fasteners, welding, adhesive, one or more brackets, and any combination thereof. The support plate 190 may have a central opening 191.

Referring back to FIGS. 1-2, the base 100 further includes at least one stabilizing bracket 192 connected at a joint between adjacent plates 104 of the plurality of plates 104 and extending radially outward relative to the plates 104. In some non-limiting embodiments or aspects, the at least one stabilizing bracket 192 may have a first portion 194 connected to the joint between adjacent plates 104 and a second portion 196 extending substantially perpendicular to the first portion 194. The at least one stabilizing bracket 192 increases the stability of the base 100 by resisting lateral loads imposed on the base 100 due to side loading on the above-ground static structure.

Although the present disclosure has been described in detail for the purpose of illustration based on what are currently considered to be the most practical and preferred embodiments or aspects, it is to be understood that such detail is solely for that purpose and that the disclosure is not limited to the disclosed embodiments or aspects, but, on the contrary, is intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect.

What is claimed is:

1. An underground base configured for supporting an above-ground static structure, the underground base comprising:

a plurality of plates each having a distal end, a proximal end, and a body portion between the distal end and the proximal end, each of the plurality of plates connected to at least another plate of the plurality of plates such that the plurality of plates defines a three-dimensional structure having an open top end and an open bottom end; and at least one reinforcement plate connected to the body portion of at least one of the plurality of plates, wherein each of the plurality of plates is made from a first material, wherein the at least one reinforcement plate is made from a second material different from the first material, wherein the distal end of each of the plurality of plates tapers inwardly from an outer surface of the body portion toward an inner surface of the body portion to define a first taper, and wherein the distal end of the at least one reinforcement plate tapers outwardly from an inner surface toward an outer surface of the at least one reinforcement plate to define a second taper.

2. The base of claim 1, wherein the first material is steel, and wherein the second material is a polymer.

3. The underground base according to claim 1, wherein each of the plates comprises:

a first bend line between the proximal end and the distal end extending along a longitudinal length of the body portion; and a second bend line between the proximal end and the distal end extending along the longitudinal length of the body portion.

4. The underground base according to claim 3, wherein the at least one reinforcement plate is connected to the body portion of at least one of the plurality of plates between the first bend line and the second bend line.

5. The underground base according to claim 4, wherein the first bend line is substantially parallel to the second bend line.

6. The underground base according to claim 4, wherein the first bend line defines an angle of 22.5° to 45° between a first portion and a second portion of the body portion, and wherein the second bend line defines an angle of 22.5° to 45° between the first portion and a third portion of the body portion.

7. The underground base according to claim 1, wherein the first taper and the second taper define an angle of 45° to 65°.

8. The underground base of claim 1, further comprising a plurality of brackets each connected to one of the plurality of pile plates.

9. The underground base according to claim 8, wherein each of the plurality of brackets comprises:

a bracket distal end;

a bracket proximal end;

a bracket body portion between the bracket proximal end and the bracket distal end;

a first bend line between the bracket proximal end and the bracket distal end extending along a longitudinal length of the bracket body portion;

a second bend line between the bracket proximal end and the bracket distal end extending along the longitudinal length of the bracket body portion; and a flap at the bracket proximal end.

10. The underground base according to claim 9, wherein the first bend line and the second bend line each extend along a full longitudinal length of the bracket.

11. The underground base according to claim 9, wherein the flap defines a third bend line that is substantially perpendicular to the first bend line and the second bend line.

12. The underground base according to claim 9, wherein the first bend line defines an angle of 22.5° to 45° between a first portion and a second portion of the bracket body portion, and wherein the second bend line defines an angle of 22.5° to 45° between the first portion and a third portion of the bracket body portion.

13. The underground base according to claim 9, wherein each of the plurality of brackets further comprises one or more gussets extending from the body portion of the bracket to the flap.

14. The underground base of claim 9, further comprising a base plate connected to the plurality of brackets and covering the open top end of the three-dimensional structure.

15. The underground base according to claim 14, wherein the base plate defines a plurality of holes for receiving a plurality of mechanical fasteners configured for connecting the static structure to the base plate.

16. The underground base according to claim 1, further comprising a support plate connected body portion of at least two of the plurality of plates and disposed between the distal end and the proximal end of the plurality of plates.

17. The underground base according to claim 1, further comprising at least one stabilizing bracket connected at a joint between adjacent plates of the plurality of plates and extending radially outward relative to the body portion of the plates.

18. The underground base according to claim 17, wherein the at least one stabilizing bracket has a first portion connected to the joint between adjacent plates of the plurality of plates and a second portion extending substantially perpendicular to the first portion.

19. An underground base configured for supporting an above-ground static structure, the underground base comprising:

a plurality of plates each having a distal end, a proximal end, and a body portion between the distal end and the proximal end, each of the plurality of plates connected to at least another plate of the plurality of plates such that the plurality of plates defines a three-dimensional structure having an open top end and an open bottom end;

a plurality of brackets each connected to one of the plurality of pile plates;

at least one stabilizing bracket connected at a joint between adjacent plates of the plurality of plates and extending radially outward relative to the body portion of the plates; and at least one reinforcement plate connected to the body portion of at least one of the plurality of plates, wherein each of the plurality of plates is made from a first material, wherein the at least one reinforcement plate is made from a second material different from the first material, wherein the distal end of each of the plurality of plates tapers inwardly from an outer surface of the body portion toward an inner surface of the body portion to define a first taper, and wherein the distal end of the at least one reinforcement plate tapers outwardly from an inner surface toward an outer surface of the at least one reinforcement plate to define a second taper.

* * * * *